US010852089B1

(12) United States Patent
Ramirez Navarrete

(10) Patent No.: US 10,852,089 B1
(45) Date of Patent: Dec. 1, 2020

(54) INTELLIGENT TRIGGER LOCK

(71) Applicant: Ricardo Ernesto Ramirez Navarrete, Hialeah, FL (US)

(72) Inventor: Ricardo Ernesto Ramirez Navarrete, Hialeah, FL (US)

( * ) Notice: Subject to any disclaimer, the term of this patent is extended or adjusted under 35 U.S.C. 154(b) by 0 days.

(21) Appl. No.: 16/835,705

(22) Filed: Mar. 31, 2020

(51) Int. Cl.
*F41A 17/06* (2006.01)

(52) U.S. Cl.
CPC ..... *F41A 17/066* (2013.01)

(58) Field of Classification Search
CPC ..... F41A 17/54; F41A 17/066
USPC ..... 42/70.07
See application file for complete search history.

(56) References Cited

U.S. PATENT DOCUMENTS

| | | | | |
|---|---|---|---|---|
| 6,474,238 | B1 * | 11/2002 | Weinraub | F41A 17/54 42/70.07 |
| 6,722,071 | B1 * | 4/2004 | Lin | F41A 17/02 42/70.07 |
| 6,874,265 | B1 * | 4/2005 | Pathak | F41A 17/066 42/70.06 |
| 8,720,097 | B2 * | 5/2014 | Derman | F41A 17/54 42/70.07 |
| 2013/0061502 | A1 * | 3/2013 | Derman | F41A 17/54 42/70.07 |
| 2017/0191775 | A1 * | 7/2017 | Bibee | F41A 17/54 |

* cited by examiner

*Primary Examiner* — Reginald S Tillman, Jr.
(74) *Attorney, Agent, or Firm* — Trueba & Suarez, PLLC; William R. Trueba, Jr.; Roberto M. Suarez

(57) ABSTRACT

An intelligent trigger lock employs biometric authentication for securely locking a firearm by blocking access to a trigger. The intelligent trigger lock includes: a housing formed to the contours of the firearm; a cavity within the housing configured to receive the trigger; a locking pin inserted through the housing; a contact point; electronic circuitry operable to release the locking pin upon receiving biometric authentication; and a power source.

18 Claims, 13 Drawing Sheets

INTELLIGENT TRIGGER LOCK

CROSS-REFERENCE TO RELATED APPLICATIONS

None.

FIELD OF THE INVENTION

The present invention generally relates to firearm safety and particularly relates to an intelligent trigger lock apparatus, system, and method for preventing unauthorized access to the trigger of a firearm.

BACKGROUND OF THE INVENTION

Within the framework of gun safety, numerous locking mechanisms have been utilized to prevent the accidental or unauthorized firing of a weapon. Some of the most widely-used locking mechanisms are simple padlocks with a manual implementation. The most commonly-used gun locks are: a locking padlock with a combination lock and a locking padlock with a key lock, where either the combination or the key is kept in the possession of the gun owner and no one else can access the weapon.

Most trigger lock mechanisms currently known in the art employ a one-to-one relationship between the lock and the user. Meaning, in the case of a keyed or combination lock, only the one person that has the key or combination can unlock the firearm. In the case of trigger lock mechanisms that utilize biometric readers, only the one fingerprint assigned to the user will unlock the apparatus.

Therefore, there is a need in the art for a secure and durable firearm locking mechanism that is secure, yet easy to access by one or more authorized users without the need to find a key or to fumble with a combination code.

SUMMARY

We disclose and discuss here a secure and durable firearm locking apparatus, as well as, a system having the firearm locking apparatus as a key component and a method of using the firearm locking apparatus disclosed herein.

Briefly, according to an embodiment of the present invention, we describe an intelligent trigger lock using biometric authentication for securely locking a firearm by blocking access to a trigger. The intelligent trigger lock includes, at least: a housing formed to contours of the firearm; a cavity within the housing configured to receive a trigger portion of the firearm; a locking pin removably inserted through one side of the housing, across the cavity and received into a slot in another side of the housing opposite the first side where, when in the locked position, no part of the locking pin is left protruding from the apparatus; a contact point in the slot; electronic circuitry operable to release the locking pin; a logic with a memory; and a power source.

According to another embodiment of the present invention, a method for securing a firearm with an intelligent trigger lock using biometric authentication includes steps or acts of: securing the intelligent trigger lock to the trigger portion of the firearm by insertion of the locking pin forward of the trigger to make contact with the contact point; receiving the signal authenticating biometric data associated with the firearm; based upon receiving the signal, releasing the locking pin, thereby enabling uncoupling of the intelligent trigger lock from the firearm; and setting a status indicator to unlocked.

BRIEF DESCRIPTION OF THE DRAWINGS

In the accompanying figures, like reference numerals refer to identical or functionally similar elements throughout the separate views. The accompanying figures, together with the detailed description below are incorporated in, and form part of, the specification and serve to further illustrate various embodiments and to explain various principles and advantages all in accordance with the present invention, in which.

DETAILED DESCRIPTION

Embodiments of the present disclosure provide an intelligent trigger lock to prevent the accidental or unauthorized firing of a weapon by blocking access to a gun trigger. The intelligent trigger lock, once actuated to be in the locked state, is quickly and easily unlocked by biometric authentication so that only an authorized user with biometric characteristics matching stored biometric data can release the locking pin, remove the intelligent trigger lock and access the trigger.

Figure 1:
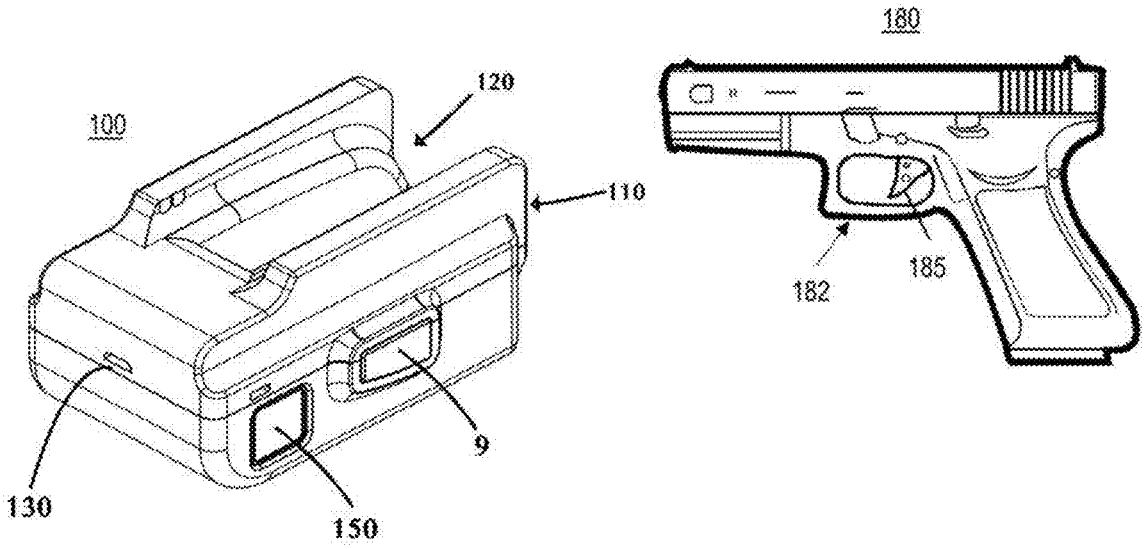
FIG. 1 is a perspective view of the intelligent trigger lock in the locked position with the pin fully inserted.

Referring now to the drawings in general, and to FIG. 1 in particular, there is shown a perspective view of one exemplary embodiment of an intelligent trigger lock 100 integrated with a biometric interface 150 component, such as, for example, a fingerprint sensor. The weapon 180 depicted in the drawings is one non-limiting example of a weapon that can be safeguarded by an intelligent trigger lock 100. The intelligent trigger lock 100 is designed to completely surround and encase a trigger guard 182 when mechanically coupled with a weapon 180 such as the handgun shown in FIG. 1.

For clarification, in any figure or drawing, or when mentioned in this disclosure, the firearms, handguns, and weapons shown are for reference only, they are not intended to limit the invention disclosed to any one particular model or style of firearm, and do not form a part of the claimed apparatus, system, or method, unless specifically recited in a claim.

The housing 110 of the intelligent trigger lock 100 is manufactured of a durable material such as, for example, a polycarbonate or a zinc alloy. The housing 110 is formed to the contours of the weapon 180 for a snug, tamper-proof fit. It is therefore contemplated that various embodiments of the invention may be produced to mate properly with different weapon models and styles. When the weapon 180 is in inserted relation with respect to the intelligent trigger lock 100 and locked into place by the locking plug 9, the trigger 185 and, in fact, the entire trigger guard 182, is completely inaccessible. In one embodiment, the weapon 180 slides into the cavity 120 of the intelligent trigger lock 100. In another embodiment, the weapon is snapped into place.

The contoured shape of the intelligent trigger lock 100 is formed to fit a weapon 180 such that there is, substantially, no "give," providing a tamper-proof and reliable safety mechanism. The close fit of the intelligent trigger lock 100 assures that the trigger 185 can't be pulled by, for example, inserting a thread or cable into a gap between the housing 100 and the trigger 185.

The cavity 120 (hollow area) of the intelligent trigger lock 100 is configured to receive the weapon 180 in inserted relation with surfaces substantially co-planar to and substantially mated to the surfaces of the inserted weapon 180 such that gaps between the mating surfaces are substantially eliminated. In embodiments, a gap tolerance of 0.1 mm or less is preferred, although the invention is still operable for its purpose if a larger gap is present. The purpose of this configuration is to frustrate any efforts to insert an object such as a cable or string into the cavity 120 and use the cable or string to pull the trigger 185.

FIG. 1 depicts the intelligent trigger lock 100 in the locked position with the locking plug 9 fully inserted. In this position, the locking plug 9 fully extends across the cavity 120 which is shaped to receive the trigger guard 182 of the particular weapon 180, as shown in FIG. 1. When in the locked position as shown in FIG. 1, no part of the locking pin 9 protrudes from the intelligent trigger lock 100, providing a flush, tamper-proof surface.

Figure 16:
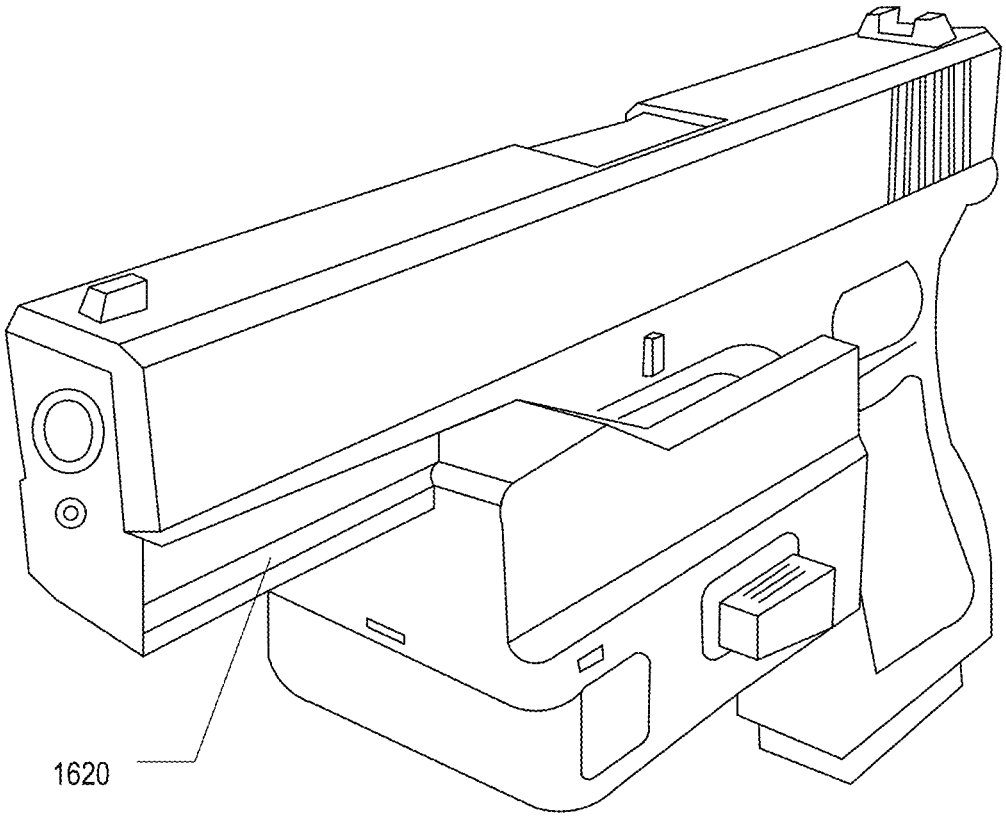
FIG. 16 shows the intelligent trigger lock mounted to a handgun equipped with a Picatinny rail.

One with knowledge in the art will appreciate that the surfaces defining the cavity 120 of the intelligent trigger lock 100 will be formed according to the make, model, or style of weapon 180 with which the intelligent trigger lock 100 will be paired. Sidewalls of the housing 110 are defined by protrusions extending from the housing, lateral to and on either side of the cavity 120, toward the barrel of the weapon 180 such that they completely encase the trigger guard 182. In some embodiments, the intelligent trigger lock 100 can be clipped to the weapon 180 using Weaver or Picatinny rails, or equivalent rail accessory, for greater stability as well as security. An example showing a weapon 180 with the intelligent trigger lock 100 anchored to the weapon's Picatinny rail 1620 is shown in FIG. 16.

Figure 17:
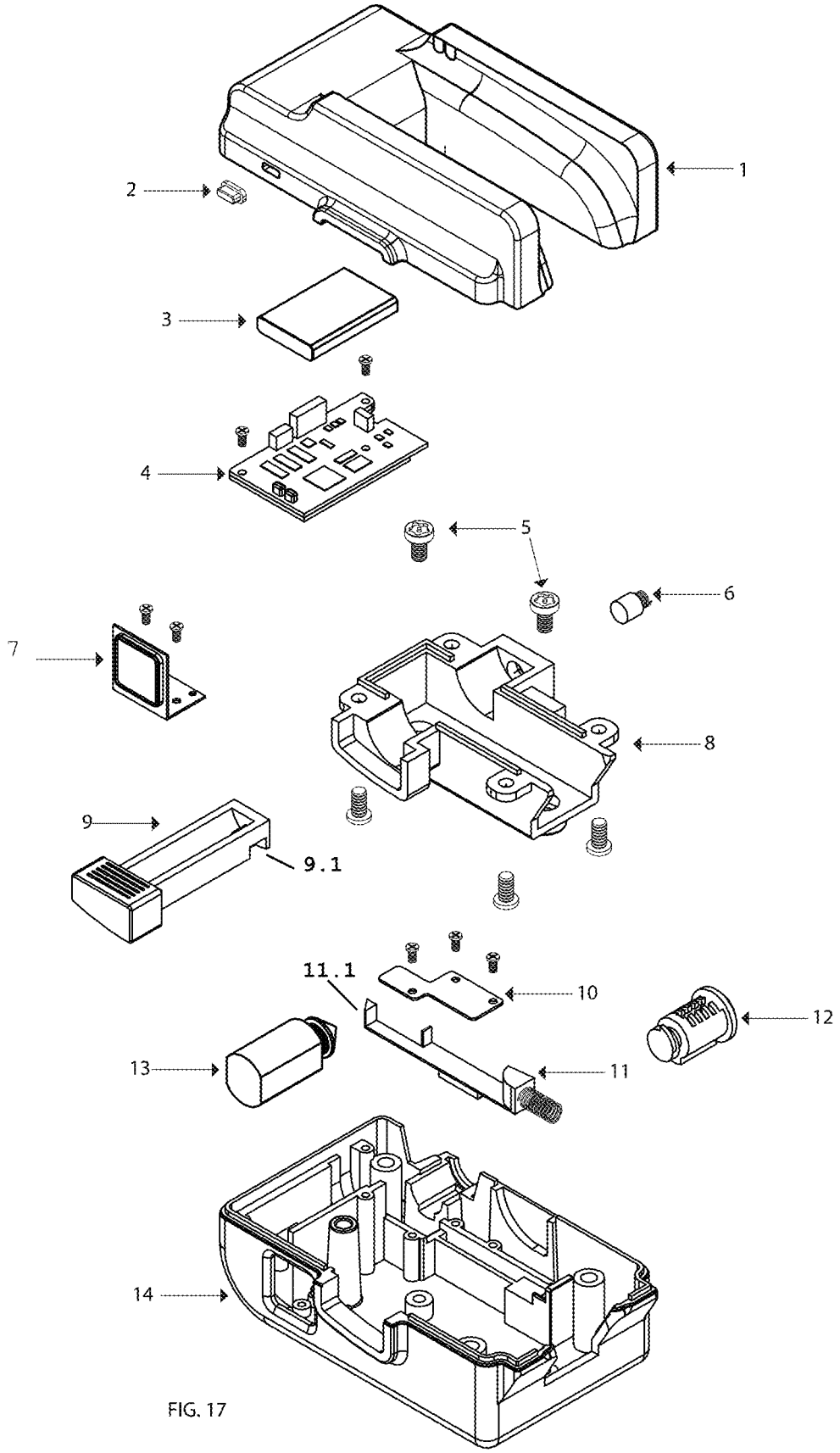
FIG. 17 shows an exploded view of the intelligent trigger lock.

Turning now to FIG. 17, there is shown an exploded view of a preferred embodiment of the intelligent trigger lock 100. Table 1750 (below) lists the various parts of the intelligent trigger lock 100.

FIG. 17 shows the upper housing 1 and the lower housing 14. Disposed in between the upper housing 1 and the lower housing 14 is the locking device section 8. The locking device section 8 is secured by security screws 5. The heads of the security screws 5 are located within the cavity portion of the lock which is inaccessible while the lock is secured onto the weapon, thereby assuring that the locking portion of the intelligent trigger lock 100 is completely tamper-proof. Additionally, the security screws 5 may be configured with specific screwdriver heads, such as Security T, Torx, Pozidriv, Hexagon, and the like, or further "keyed" for removal only with a proprietary tool.

Figure 18:
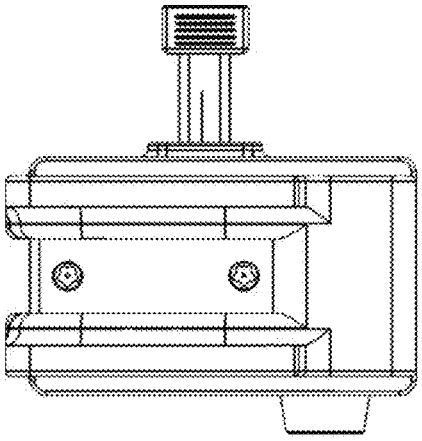
FIG. 18 shows a perspective view inside the intelligent trigger lock.
Figure 18:
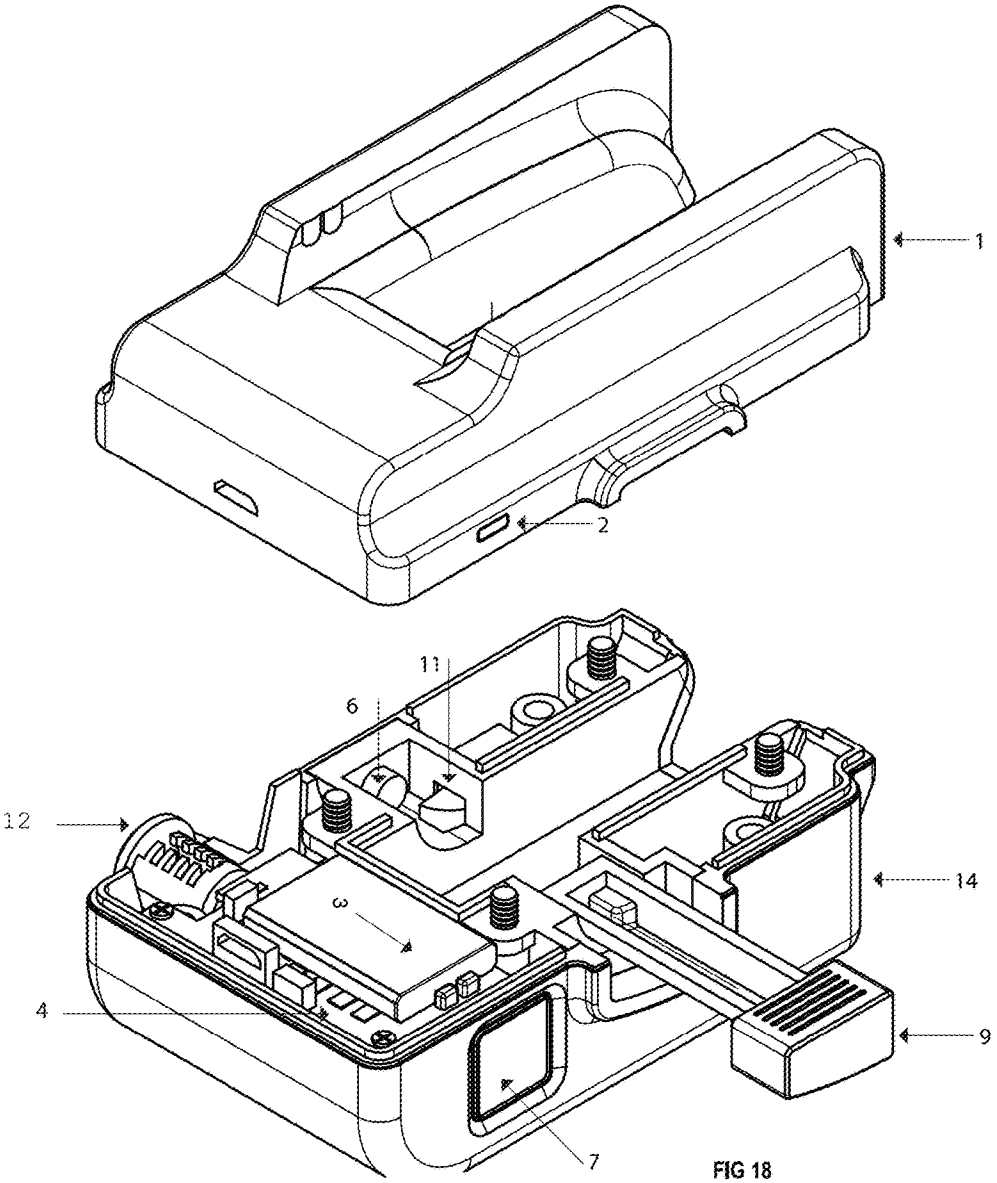

In FIG. 17, we see that the locking plug 9 has a notched portion 9.1 at its distal end, forming a mating recess. This notched portion, which is also shown in FIG. 18, engages with a diagonally-shaped protrusion 11.1 at one end of the locking pin structure 11. This point of engagement, where the protrusion at the locking pin structure 11 engages with the notched portion of the locking plug 9, serves to bias the locking pin structure 11 in a normally locked position. The locking pin structure 11 is slideably engaged with the lower housing 14.

Figure 7:
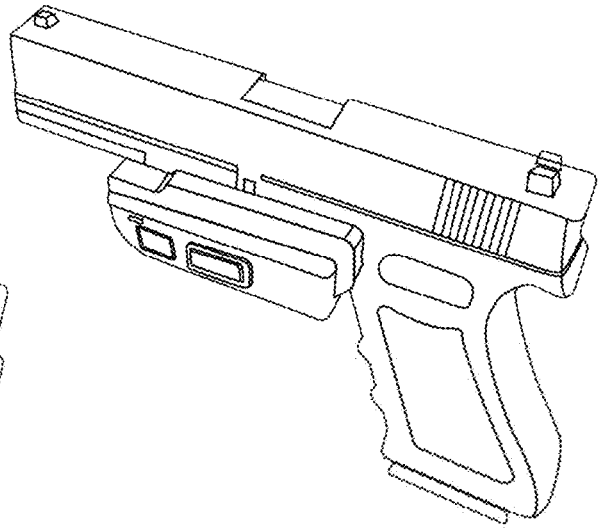
FIG. 7 shows the intelligent trigger lock coupled with a weapon, in the locked position.
Figure 13:
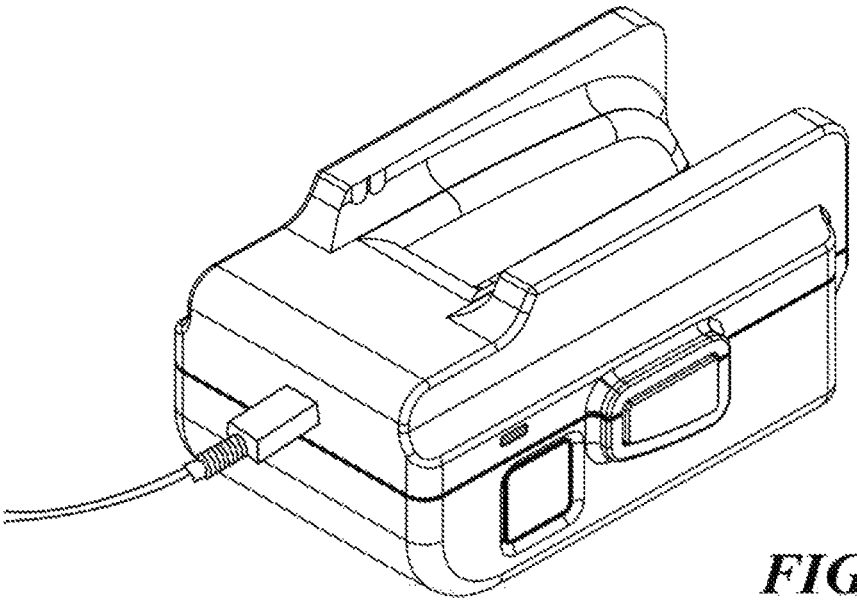
FIG. 13 shows the charging port of the intelligent trigger lock.

The locking plug 9, when engaged in the in the fully locked position, is completely within the outer surfaces of the housing. Specifically, there is no part of the locking plug 9 that protrudes outwardly from any surface of the housing. Therefore, there is no way to be able to grab or remove the locking pin structure from the housing when it is in this locked position. This is illustrated in FIGS. 1, 7 and 13.

A biometric sensor 7, such as, but not limited to, a fingerprint sensor, is disposed on the outside surface of the lower housing 14. The biometric sensor 7 is communicatively coupled with electronic circuitry 4 disposed within the lower housing 14. The electronic circuitry 4 is operable to receive a signal from the biometric sensor 7 and compare it to a stored biometric identification. If a match is found, the electronic circuitry 4 sends a signal to the solenoid 13 to disengage the locking pin structure 11 from the locking plug 9, thus unlocking the trigger guard 182 so that the weapon 180 can be un-coupled from the housing 110. The electronic components 4 can include a small memory unit storing at least one biometric profile.

In a preferred embodiment, the intelligent trigger lock 100 includes a biometric sensor 7 that is a CMOS fingerprint sensor to ensure accuracy, security, and reliability. With this type of fingerprint sensor, there is never a wrong finger position. A user can unlock the apparatus by pressing the registered fingerprint against the sensor at any angle. Typically, these advanced fingerprint sensors recognize fingerprints in less than 0.3 seconds, thereby significantly reducing the time required to unlock the weapon.

The following Table 1750 is provided as a legend for the element numbers and descriptions shown in the figures.

| Part No. | Description |
|---|---|
| 1 | upper housing |
| 2 | acrylic screen for LED light |
| 3 | battery |
| 4 | electronic card |
| 5 | security screws |
| 6 | spring |

-continued

| Part No. | Description |
|---|---|
| 7 | fingerprint reader |
| 8 | device cover |
| 9 | plug |
| 10 | pin clamping blade |
| 11 | pin |
| 11.1 | pin protrusion |
| 12 | lock |
| 13 | solenoid bolt |
| 14 | lower housing |

Advances in technology have made it possible to house circuitry for performing fingerprint identification, facial recognition, voice recognition, radio frequency identification (RFID), and Near Field Communication (NFC), inter alia, in a small device. For compactness of disclosure, the details of these biometric identification devices are not disclosed in detail and is known to the ordinarily skilled artisan. In some embodiments, the biometric identification takes place at the intelligent trigger lock 100, with the hardware and circuitry required to make the identification and compare with stored biometric data stored within and integral to the device itself. Additionally, the biometric data itself can be stored within the intelligent trigger lock 100.

In other embodiments, the biometric identification takes place at a mobile device which then sends a lock/unlock signal to the intelligent trigger lock 100. Technology such as facial recognition and fingerprint identification can be paired with a mobile application such that a user is able to use his/her smart device such as a phone or tablet to grant access to another device. Once the user performs a biometric authentication on a mobile device, the mobile device sends the signal to the electronic circuitry in the intelligent trigger lock 100 to lock/unlock. For example, if the user's mobile device has a fingerprint reader and the mobile device is paired with the intelligent trigger lock 100, a fingerprint reading on the mobile device can lock/unlock the intelligent trigger lock 100. The two devices must have a wireless data interconnection.

A preferred embodiment of the intelligent trigger lock 100 is configured to allow a user to enroll up to ten authorized fingerprints, of which one is the administrator and up to nine more are additional users who can be another person or the administrator's own other fingerprints.

Figure 2:
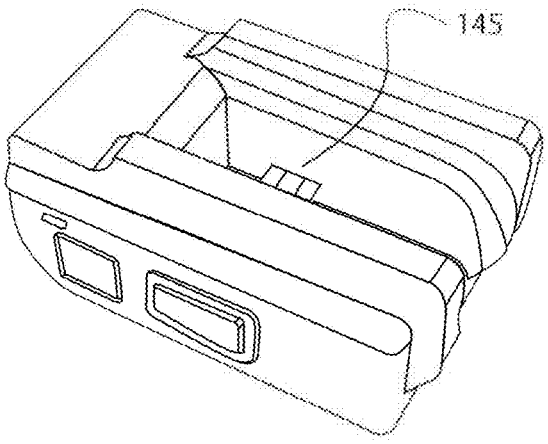
FIG. 2 is a top perspective view of the intelligent trigger lock showing the pin traversing the cavity.

FIG. 2 shows a top perspective view of the intelligent trigger lock 100 in the locked position, with the locking plug 9 fully inserted into the housing 110 at a plug insertion point, extending across and through the cavity 120 and received into a slot opening 145 integral to a cavity surface opposite the plug insertion point, where the locking plug 9 mechanically engages with the locking pin structure 11 integral to the lower housing 14. The locking pin structure 11 is constrained and held in place by plate 10 (shown in FIG. 17). The locking pin structure 11 is formed of a hardened, tamper-proof, and durable material such as steel.

Figure 3:
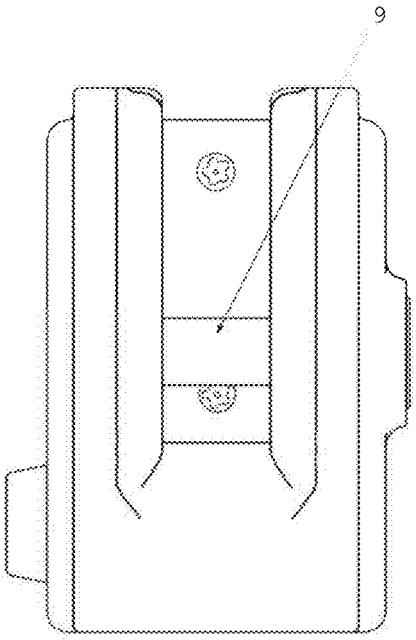
FIG. 3 is a top view of the intelligent trigger lock.
Figure 4:
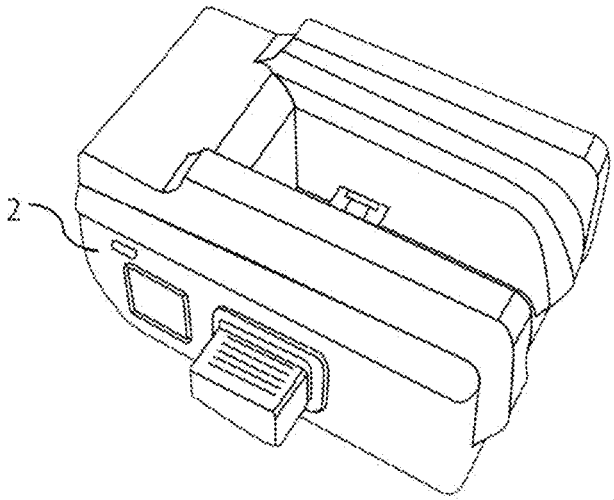
FIG. 4 is a top perspective view of the intelligent trigger lock showing the status indicator on and the pin partially ejected.
Figure 5:
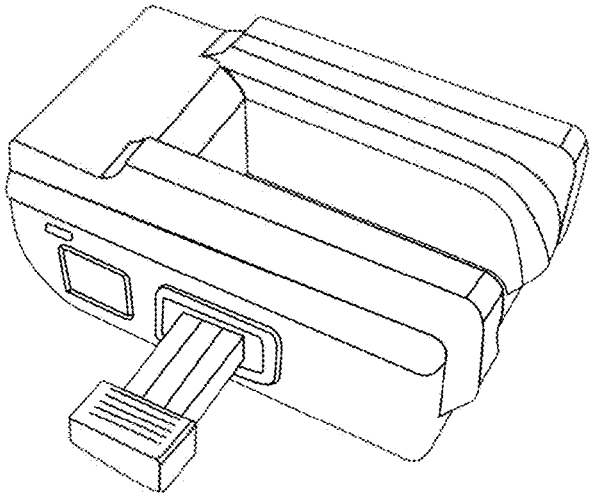
FIG. 5 is a top perspective view of the intelligent trigger lock showing the pin almost completely ejected.

FIG. 3 is a top view of the intelligent trigger lock 100 with the locking plug 9 fully inserted. Once actuated by the electronic circuitry upon authentication of biometric data, the locking plug 9 slides through the aperture across the cavity 120 to make contact with the locking pin structure 11, thereby locking the intelligent trigger lock 100. FIG. 4 is a top perspective view of the intelligent trigger lock 100 showing the locking plug 9 partially ejected. FIG. 4 also shows the status indicator 2 providing an indicator of the current status of the intelligent trigger lock 100 (locked or un-locked). In a non-limiting example, the status indicator 2 is an LED (light-emitting diode) changing from red to green depending on the status. The locking plug 9 in FIG. 5 is shown fully ejected. In this position, the cavity 120 remains empty with nothing to impede acceptance of the trigger guard 182.

Figure 6:
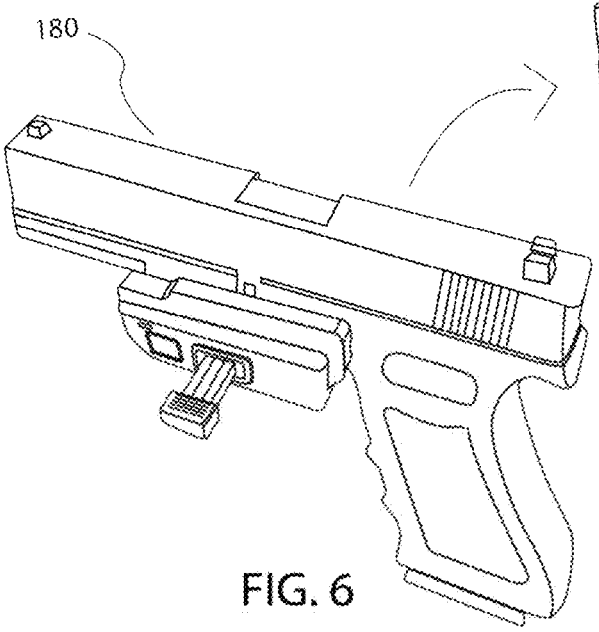
FIG. 6 shows the intelligent trigger lock coupled with a weapon, in the unlocked position.
Figure 19:
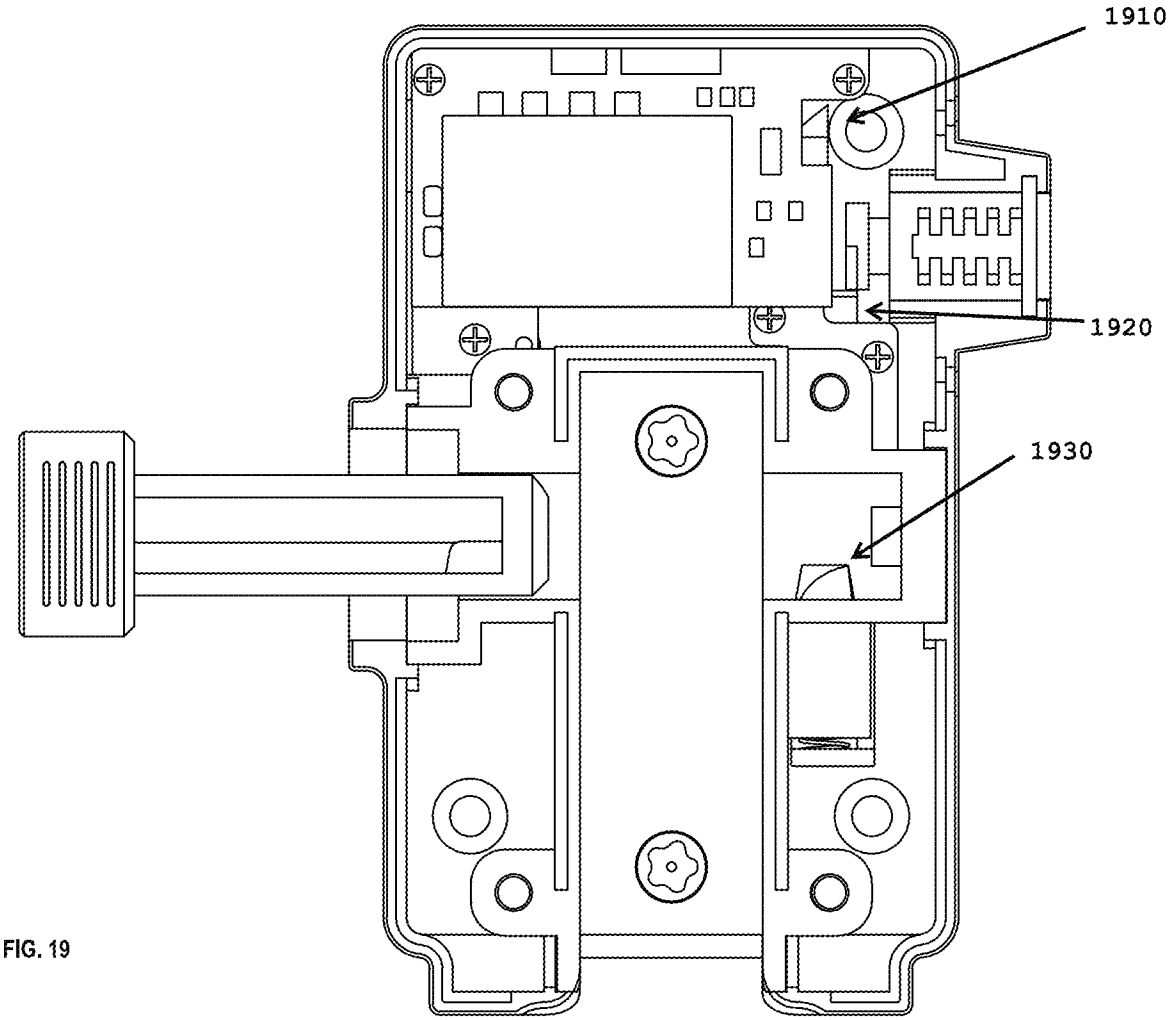
FIG. 19 shows a top view of the bottom portion of the intelligent trigger lock.

FIG. 6 shows a weapon 180 with the intelligent trigger lock 100 in the unlocked position, the locking plug 9 ejected by an internal spring mechanism 6, portions of which are shown in FIG. 18. FIG. 7 shows the intelligent trigger lock 100 in locked mode. Referring now to FIG. 19, there is shown a top view of the lower housing 14 showing the locking components. FIG. 19 provides a view showing how the solenoid plunger 13 engages with a protrusion at one end of the locking pin structure 11. FIG. 19 also shows the mechanical lock 12 in contact with a center portion of the locking pin structure 11.

Although the device cover 8 obscures portions of the locking pin structure 11, FIG. 19 highlights the three points of contact of the locking pin structure 11. Starting from the top, the first point of contact 1910 is with the solenoid plunger 13; the second point of contact 1920 is with the mechanical lock 12; and the third point of contact 1930 is with the locking plug 9. A solenoid bolt or plunger 13 can be optionally configured to fail closed (the device is locked upon power loss). After a power failure, the intelligent trigger lock 100 needs to be re-charged to place it into operational mode. Alternatively, the intelligent trigger lock 100 can be opened by manual key, described below.

Figure 8:
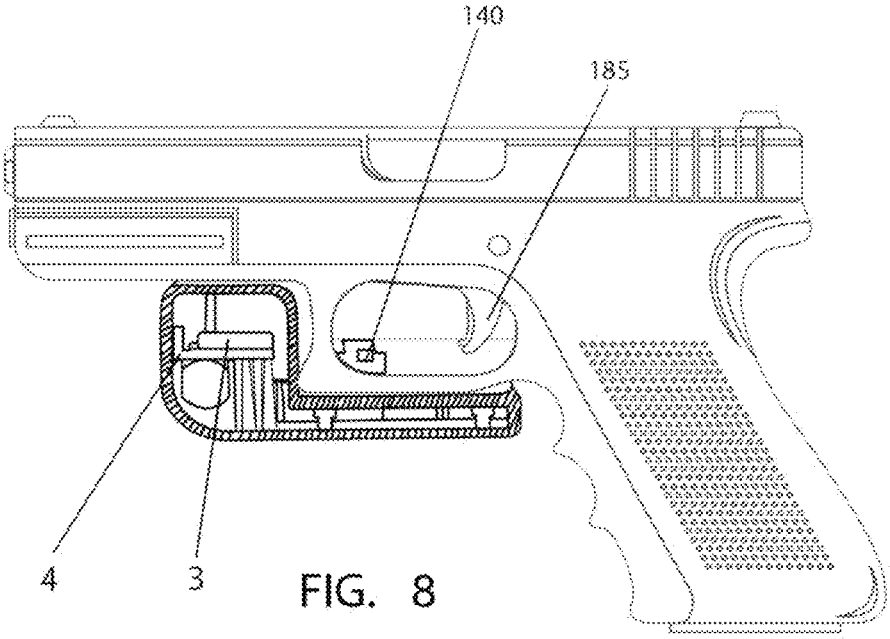
FIG. 8 shows a cross-sectional view of the intelligent trigger lock coupled with a weapon, in the locked position.
Figure 9A:
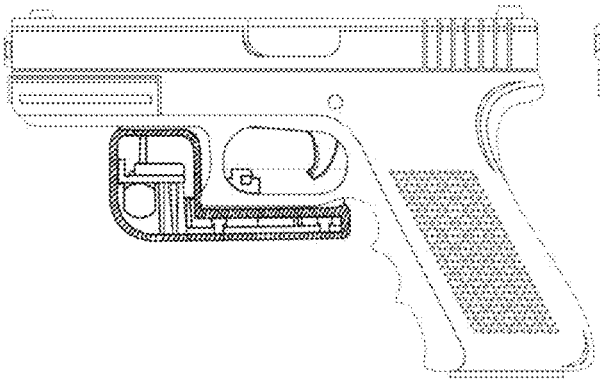
FIG. 9A shows the trigger in a compressed state.
Figure 9B:
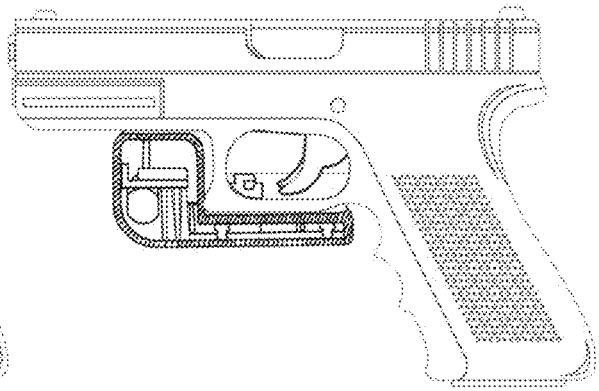
FIG. 9B shows the trigger in a reset state.
Figure 10:
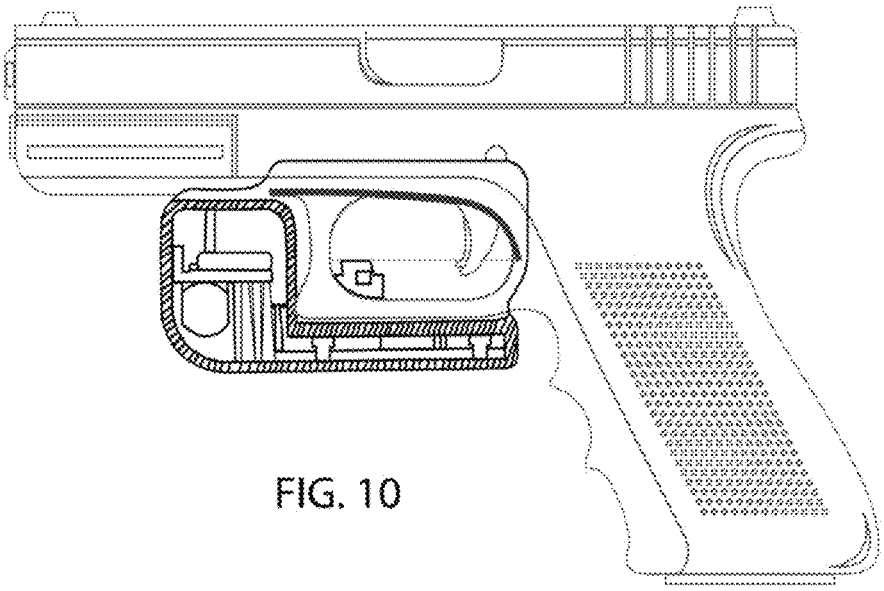
FIG. 10 shows the coupling curve of the intelligent trigger lock.
Figure 11:
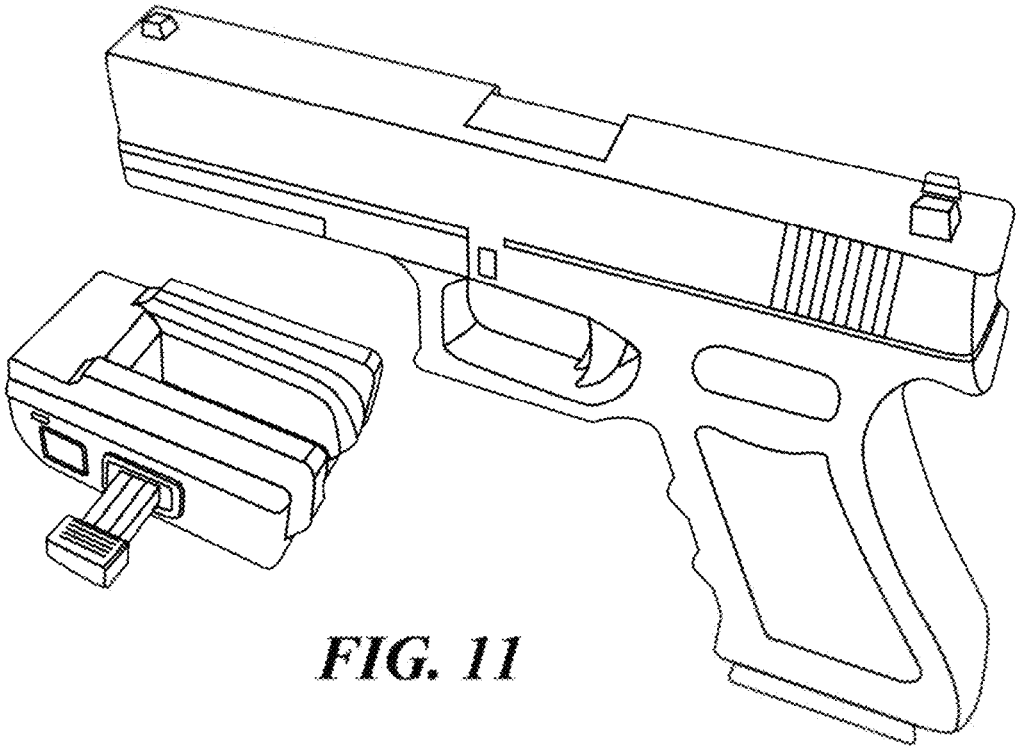
FIG. 11 shows the decoupled intelligent trigger lock.

FIG. 8 shows a cross-sectional side view of the intelligent trigger lock 100 showing a portion of the interior of the intelligent trigger lock 100. Note how the locking plug 9 is positioned forward of the trigger 185. Also shown are a representation of the electro-mechanical components 4 used for the biometric authentication, as well as a power source, such as a battery 3. Other power sources are contemplated within the spirit and scope of the invention. FIG. 9A and FIG. 9B show the same cross-section view of FIG. 8, with the trigger 185 in two different positions. FIG. 10 shows how the curvature of the cavity 120 lines up perfectly with the shape of the weapon 180. FIG. 11 shows the intelligent trigger lock 100 ready to accept a weapon 180.

Figure 20A:
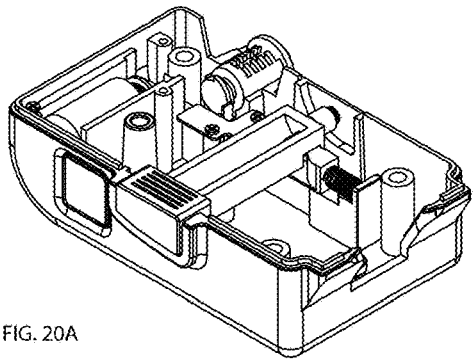
FIGS. 20A, 20B, 20C, 20D, 20E, and 20F are images of the mechanical operation of the intelligent trigger lock using the fingerprint reader.
Figure 20B:
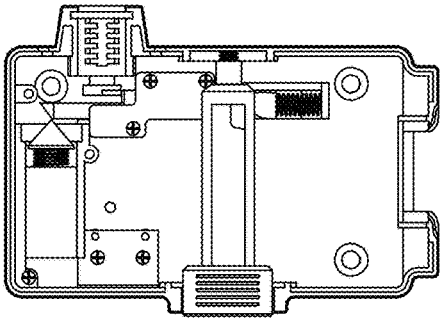

Referring now to FIGS. 20A through 20F, there are shown illustrations of the mechanical operation of the intelligent trigger lock 100 using the fingerprint sensor 7. In these illustrations, the intelligent trigger lock 100 is illustrated with the upper housing 1 removed in order to show the internal mechanical movements of the intelligent trigger lock 100 during operation. FIG. 20A shows a perspective view of the mechanical components in the locked position. Note that the locking plug 9 is fully inserted and held in place by the sliding locking pin structure 11. FIG. 20B shows a top view of the mechanical components when the intelligent trigger lock 100 is in the locked position.

Figure 20C:
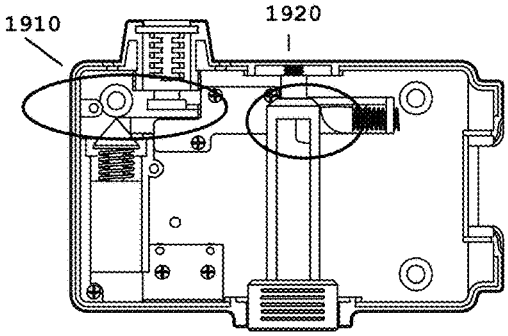
Figure 20D:
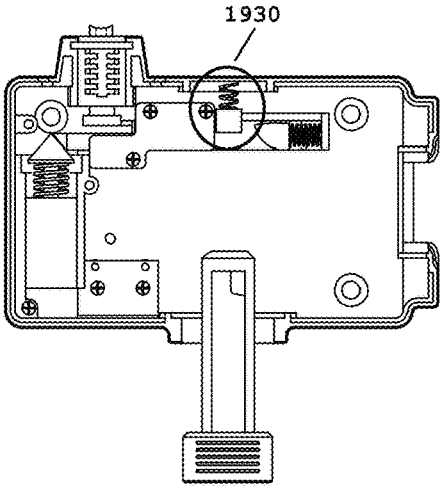
Figure 20E:
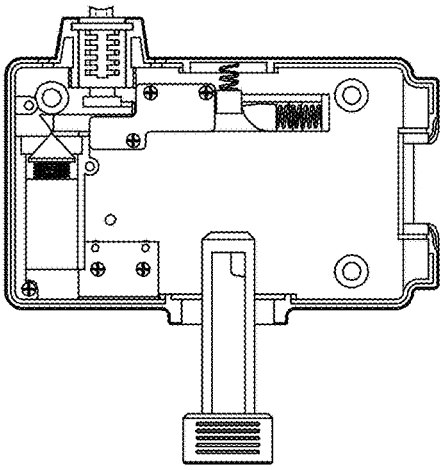
Figure 20F:
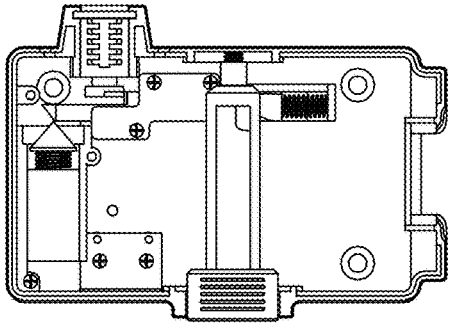

Once actuated by confirmation of biometric data input through the biometric sensor 7, the electrical components 4 activate the solenoid plunger 13, propelling it forward, thus exerting pressure at the first contact point 1910, thereby displacing the locking pin structure 11 that anchors the locking plug 9 at the second point of contact 1920 (shown in FIG. 20C). FIG. 20D shows the locking plug 9, now disengaged, released by the spring 6 which uncoils when the locking plug 9 is disengaged by the locking pin structure 11. This spring 6 then propels the locking plug 9 out of the device 100. After the locking plug 9 is released in FIG. 20E, the tension on the solenoid plunger 13 and locking pin structure 11 is eased, therefore they both return to their original positions. FIG. 20F shows the device 100 now returned to its original locked position by insertion of the locking plug 9.

Figure 12:
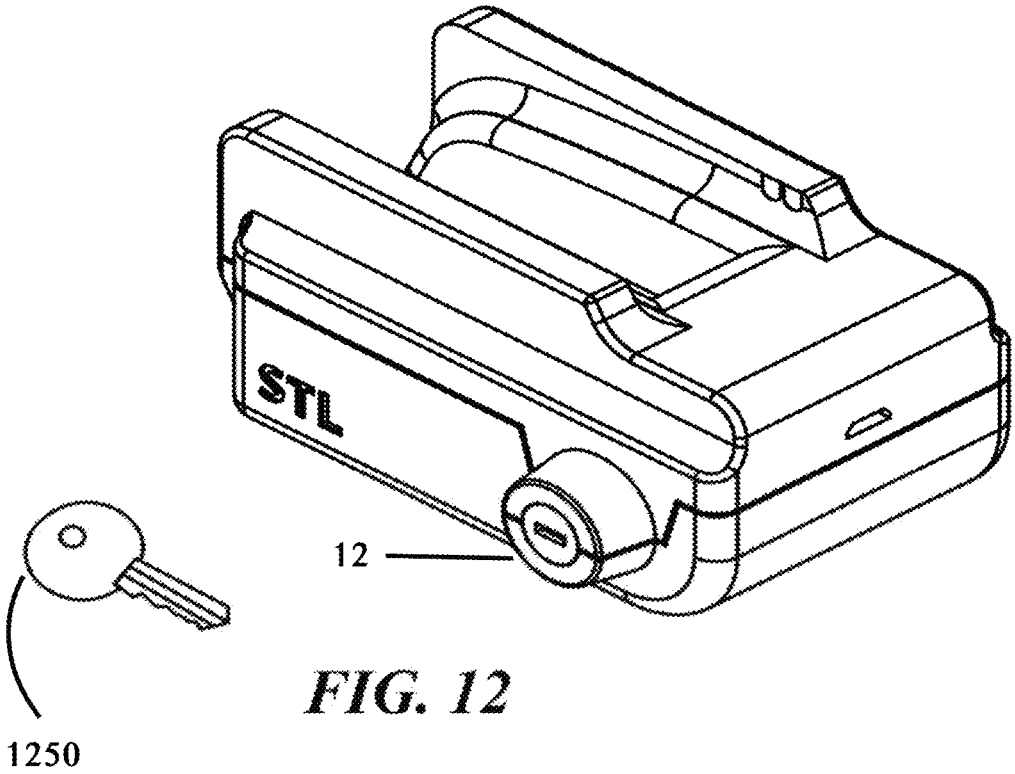
FIG. 12 shows a back perspective of the intelligent trigger lock with a mechanical lock implementation.
Figure 21A:
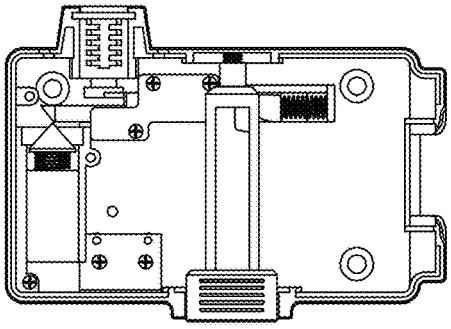
FIGS. 21A, 21B, and 21C are images of the mechanical operation of the intelligent trigger lock via key operation.
Figure 21B:
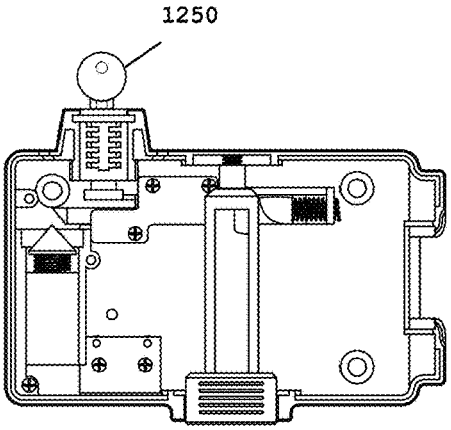
Figure 21C:
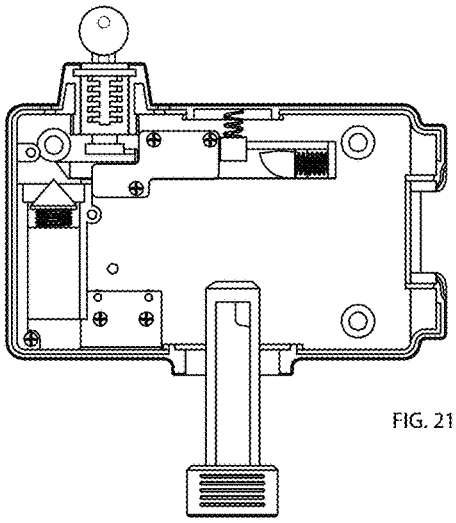

We have discussed various ways in which the intelligent trigger lock 100 implements biometric technology to secure a firearm 180. But what about an instance where the electronics fail? Perhaps the battery has died or there is a problem with the biometric identification. In that case, FIG. 12 shows the intelligent trigger lock 100 with a manual key lock 12. The manual key lock 12 receives a key 1250 for locking/unlocking the device 100. Now turning to FIGS. 21A through 21C, we show the mechanical operation of the intelligent trigger lock 100 using the manual key lock 12. This is an alternative method for unlocking the intelligent trigger lock 100. FIG. 21A shows the components in the locked position. FIG. 21B shows a key 1250 inserted into the key lock 12. Rotation of the key 1250 in the key lock 12 engages the locking pin structure 11 at the second contact point 1920 and exerts pressure on the locking pin structure 11, causing it to slide away from the locking plug 9. As shown in FIG. 21C, when the locking pin structure 11 slides away, it disengages from the locking plug 9 at the second contact point 1920. The spring element 6 then acts on the locking plug 9, propelling it out of the device 100.

Figure 14:
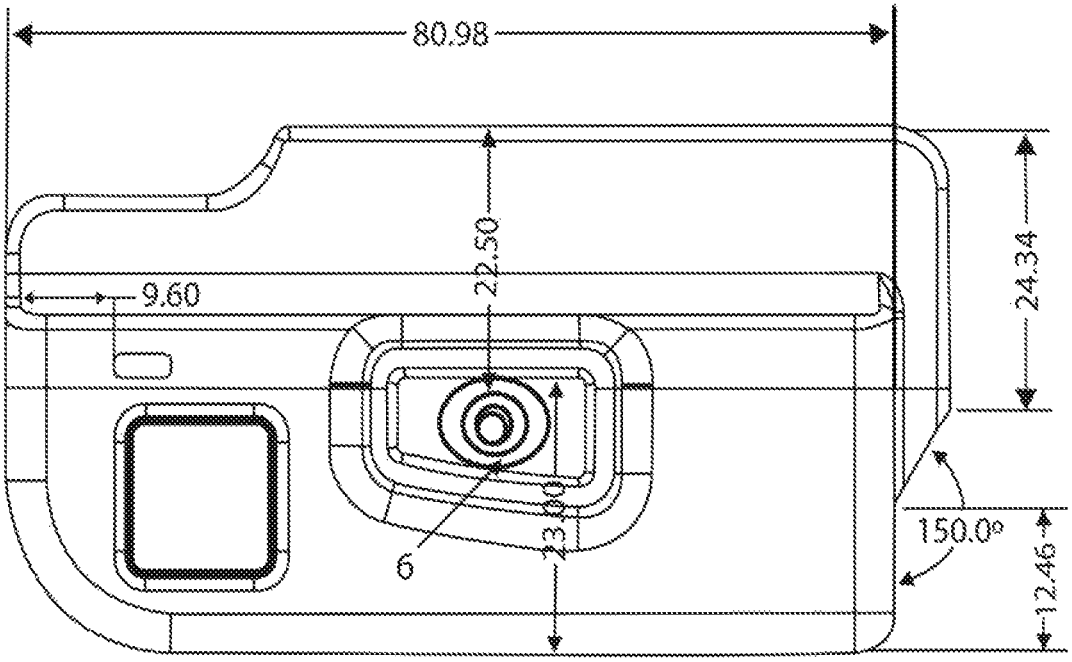
FIG. 14 is a side view of the intelligent trigger lock.

FIG. 13 shows the intelligent trigger lock 100 with a charger cable inserted into the charging port 130, charging the internal battery 3, such as a Lithium-ion battery. The charging cable is contemplated to be one known in the art such as, but not limited to, a USB charging cable. The status indicator 2 can also be used to indicate the power status of the lock 100. For example, an LED light can turn blue when the intelligent trigger lock 100 is fully charged. FIG. 14 is a side view showing a view of the spring 6 positioned in the device cover 8.

The internal-battery is configured to be ultra-durable and rechargeable without the need of having to charge it often. After being fully charged, the intelligent trigger lock 100 can perform the lock/unlock actions approximately 800-1000 times. The battery 3 only consumes power when someone presses his/her fingerprint (no matter if it's registered or not) on the sensor, and when performing the lock/unlock action.

Figure 15:
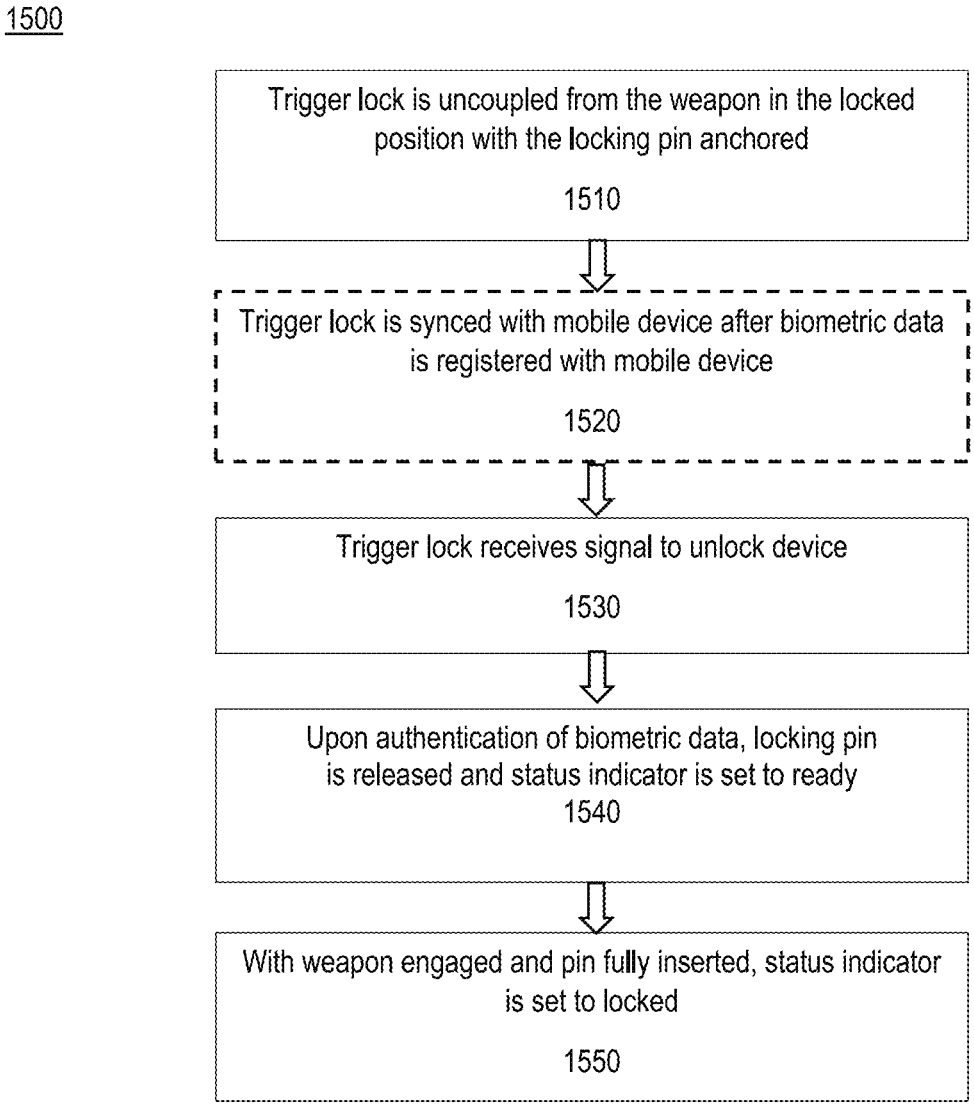
FIG. 15 is an operational flow diagram of a method for implementing the intelligent trigger lock.

Referring now to FIG. 15, there is shown an operational flow diagram 1500 of the process steps for implementing the intelligent trigger lock 100. The process begins at step 1510 with the intelligent trigger lock 100 uncoupled from the weapon 180, in the locked position with the locking plug 9 fully inserted, as shown in FIG. 1. The locking plug 9 must be ejected before the weapon can be inserted. In step 1520 the intelligent trigger lock 100 is synced or paired with a user's electronic device, such as a mobile phone, after the user has registered his biometric profile, such as a fingerprint. Note that this step may not be required in embodiments where the biometric identification is implemented in situ at the intelligent trigger lock 100, for example, in a resident memory or storage module.

In step 1530 the intelligent trigger lock 100 receives a signal to unlock. There are different ways in which the signal can be received. In one embodiment, the biometric data is received directly by the electronic circuitry 4 in the intelligent trigger lock 100. For example, the user places a thumb on the fingerprint reader 7 and the electronic circuitry 4 reads the fingerprint and matches it with a stored biometric profile. In an alternative method, a confirmation signal is received from the user's mobile device after the user enters his biometric data on the mobile device.

In step 1540 after matching the biometric reading to the user's stored biometric data, the intelligent trigger lock 100 ejects the locking plug 9 and changes the status indicator 2 to ready. Upon authentication of the biometric data, the locking plug 9 is ejected and the status indicator 2 is set to unlocked. In step 1550, once the weapon 180 is engaged and the locking plug 9 is fully inserted and held in place by the locking pin structure 11, the weapon 180 is locked in a tamper-proof device 100. The status indicator 2 is set to locked.

With respect to the status indicator 2, and other references throughout to colors of lights to represent status, it is to be understood that the invention disclosed herein is not to be limited to any particular color indicator and that other colors, flashing lights, or steady lights, are all within the scope of the present disclosure. Additionally, in embodiments where the intelligent trigger lock 100 further includes a wireless communications module and the intelligent trigger lock 100 is paired with another device, such as a mobile phone configured with a corresponding software application, then status messages can be sent from the intelligent trigger lock 100 to the mobile device via wireless communications in order to display status, or other messages as desired.

The description of the present application has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand various embodiments of the present invention, with various modifications as are suited to the particular use contemplated. Components from one embodiment can be used with another embodiment.

The invention claimed is:

1. An intelligent trigger lock using biometric authentication for securely locking a firearm by blocking access to a trigger, the intelligent trigger lock comprising:

a housing formed to contours of the firearm, with surfaces co-planar to and mated to surfaces of an inserted firearm such that gaps between mating surfaces are substantially eliminated;

a cavity within the housing configured to receive a trigger portion of the firearm in inserted relation thereto;

a locking pin removably inserted through an aperture in a first sidewall of the housing, across the cavity and received into a slot in a second sidewall opposite the first sidewall when in a locked position, such that, when in the locked position, no part of the locking pin protrudes from the housing;

a contact point in the slot for receiving a distal end of the locking pin when fully inserted;

electronic circuitry disposed in an interior of the housing for receiving a signal bio-authenticating a user desiring to access the trigger portion, the electronic circuitry operable to release the locking pin; and a power source.

2. The intelligent trigger lock of claim 1 wherein the contact point contains an electrical charge.

3. The intelligent trigger lock of claim 1 wherein the housing is configured such that the gaps between mating surfaces have a gap tolerance of 0.1 mm or less.

4. The intelligent trigger lock of claim 1 wherein the locking pin is positioned forward of the trigger when the locking pin is removably inserted into the slot.

5. The intelligent trigger lock of claim 1 further comprising a charging port disposed on an outside surface of the housing, the charging port coupled with the power source.

6. The intelligent trigger lock of claim 1 further comprising a status indicator disposed on an exterior of the housing, the status indicator displaying a lock status.

7. The intelligent trigger lock of claim 6 wherein the status indicator comprises an LED light.

8. The intelligent trigger lock of claim 1 wherein the electronic circuitry comprises electro-mechanical biometric identification circuitry operable to compare biometric input with stored biometric data; and wherein the electronic trigger lock further comprises a biometric interface communicatively coupled with the biometric recognition circuitry, the biometric interface disposed on an outside surface of the housing for receiving the biometric input.

9. The intelligent trigger lock of claim 8 wherein the biometric interface comprises a fingerprint sensor.

10. The intelligent trigger lock of claim 1, further comprising an attachment mechanism on an outside surface of the housing for attaching the intelligent trigger lock to the firearm.

11. The intelligent trigger lock of claim 10 wherein the attachment mechanism comprises rails.

12. The intelligent trigger lock of claim 1, further comprising a mechanical locking device.

13. The intelligent trigger lock of claim 1 wherein the locking pin is a solenoid bolt.

14. The intelligent trigger lock of claim 1 wherein the electronic circuitry further comprises storage for storing the biometric data.

15. A method for securing a firearm with an intelligent trigger lock using biometric authentication for securely locking the firearm by blocking access to a trigger, the method comprising:

providing the intelligent trigger lock comprising:

a housing formed to contours of the firearm, with surfaces co-planar to and mated to surfaces of an inserted firearm such that gaps between mating surfaces are substantially eliminated;

a cavity within the housing configured to receive a trigger portion of the firearm in inserted relation thereto;

a locking pin removably inserted through an aperture in a first sidewall of the housing, across the cavity and received into a slot in a second sidewall opposite the first sidewall when in a locked position, such that, when in the locked position, no part of the locking pin protrudes from the housing;

a contact point in the slot for receiving a distal end of the locking pin when fully inserted;

electronic circuitry disposed in an interior of the housing for receiving a signal bio-authenticating a user desiring to access the trigger portion, the electronic circuitry operable to release the locking pin; and a power source;

securing the intelligent trigger lock to the trigger portion of the firearm by insertion of the locking pin forward of the trigger to make contact with the contact point, thereby locking the locking pin in place;

receiving the signal authenticating biometric data associated with the firearm;

based upon receiving the signal, releasing the locking pin, thereby enabling uncoupling of the intelligent trigger lock from the firearm; and setting a status indicator to unlocked.

16. The method of claim 15 further comprising syncing the intelligent trigger lock with an electronic device storing the biometric data, wherein the signal authenticating the biometric data is received from the electronic device.

17. The method of claim 15 further comprising:

providing electro-mechanical biometric identification circuitry operable to compare biometric input with stored biometric data;

providing a biometric interface communicatively coupled with the biometric recognition circuitry, the biometric interface disposed on an outside surface of the housing for receiving the biometric input; and performing an in situ comparison of the biometric input with the stored biometric data.

18. The method of claim 17 further comprising providing a memory unit storing at least one biometric profile.

* * * * *